US010316635B2

(12) United States Patent
Molenaar et al.

(10) Patent No.: US 10,316,635 B2
(45) Date of Patent: Jun. 11, 2019

(54) MEMORY BALLS FOR CAPTURING FRACTURING INFORMATION

(71) Applicant: SHELL OIL COMPANY, Houston, TX (US)

(72) Inventors: Menno Mathieu Molenaar, Calgary (CA); David Lindsay Alexander Langille, Calgary (CA)

(73) Assignee: SHELL OIL COMPANY, Houston, TX (US)

( * ) Notice: Subject to any disclaimer, the term of this patent is extended or adjusted under 35 U.S.C. 154(b) by 449 days.

(21) Appl. No.: 15/141,249

(22) Filed: Apr. 28, 2016

(65) Prior Publication Data

US 2016/0319659 A1 Nov. 3, 2016

Related U.S. Application Data

(60) Provisional application No. 62/155,173, filed on Apr. 30, 2015.

(51) Int. Cl.
*E21B 43/26* (2006.01)

(52) U.S. Cl.
CPC ..... *E21B 43/26* (2013.01)

(58) Field of Classification Search
CPC ..... E21B 43/26; E21B 43/267; E21B 43/25; E21B 47/124; E21B 47/06; E21B 47/065
See application file for complete search history.

(56) References Cited

U.S. PATENT DOCUMENTS

| | | | |
|---|---|---|---|
| 7,451,820 | B2 | 11/2008 | Albers et al. |
| 8,183,179 | B2 | 5/2012 | Garcia-Lopez De Vicoria et al. |
| 2012/0178653 | A1* | 7/2012 | McClung, III ..... B82Y 15/00 507/269 |
| 2012/0193090 | A1 | 8/2012 | Lopez De Cardenas |
| 2013/0118733 | A1 | 5/2013 | Kumar |

OTHER PUBLICATIONS

Yu et al., "A Distributed Microchip System for Subsurface Measurement", SPE paper 159583, Journal of Petroleum Technology, Sep. 2013, p. 123.

* cited by examiner

*Primary Examiner* — Wei Wang

(57) ABSTRACT

The present invention is a method to determine where fractures are created within a wellbore during a formation fracturing operation, the method comprising the steps of: providing at least one sensor within a carrier capable of measuring and recording a pressure difference across the carrier as a function of time; releasing the sensor into fracturing fluids; injecting fracturing fluids into a wellbore during a fracturing operation; after at least one fracture has formed, permitting fluids to flow back from the fractured formation into the wellbore and to a surface facility; capturing at least one sensor from the fluids which flowed back from the fractured formation; reading recorded data from the captured sensor; and determining the relative size of at least two different fractures based on the recorded data.

13 Claims, No Drawings

MEMORY BALLS FOR CAPTURING FRACTURING INFORMATION

RELATED APPLICATIONS

This application claims priority to U.S. provisional application 62/155,173, filed on Apr. 30, 2015, the contents of which are incorporated herein by reference.

BACKGROUND OF THE INVENTION

US patent application publication 2013/0118733 suggests the release of balls that are capable of measuring and recording information into drilling fluid, and subsequently capturing and downloading the captured data from the balls. Properties of interest are listed as temperature, pressure, density, viscosity, compressibility, acoustic property, magnetic property, chemical composition and material characteristics of the formation, fluid in the formation, drill string components, and drilling fluid. The data is said to be potentially useful for detection of corrosion, scaling, asphaltenes and waxes. The property of interest can be an ambient condition experienced by the sensor, or a characteristic of a downhole material such as the formation or formation fluid. Data can be stored within the ball, and then downloaded wirelessly at the surface after the balls are recovered from the drilling fluids. The balls can pass through drill bits and measure conditions as drilling is continuing.

Hydraulic fracturing is used to increase the area of a formation that is in communication with a wellbore and therefore increasing either production of fluids from the wellbore, or increasing the amount of fluids that may be injected into the formation from the wellbore. Hydraulic fracturing has been in commercial use for many decades, but gradual improvements in the size of fractures that can be created and the cost effectiveness of the fractures, along with developments like improved horizontal drilling, have resulted in hydraulic fracturing enabling production of hydrocarbons from formations such as source rocks or other very low permeability formations, that were previously not thought to be economically producible.

Typically, gas and/or oil, referred to as light tight oil, is produced from low permeability formations such as source rocks, by providing horizontal wells in the formations for distances of a mile or more. The formation is then fractured from the wellbores in as many as twenty or thirty places, with the fractures placed every 50 to 150 meters along the horizontal wellbore. The fractures are provided by pumping fracturing fluids into an isolated section of the wellbore that is in communication with formation at pressures that exceeds a rupture strength of the reservoir rock. The fracturing fluids are pumped to further propagate the fracture while a proppant is added to the fracturing treatment to hold the hydraulically induced fractures open when the pumping pressure is reduced.

Fractures are either propped open after they are formed by including in the fracturing fluids materials such as finely sized sands or ceramic particles, or in carbonate formations, permeability through fractures may be created by including acids in the fracturing which dissolve some minerals at the face of the fracture to create wormholes along the rock surfaces of the fractures. Proppants may be held is suspension within the fracturing fluids by including additives to increase the viscosity of the fracturing fluids, to decrease the settling rate of the proppants. Alternatively, or in addition, proppants may be utilized with lower densities to decrease the rate at which they settle in the fracture fluids, Polymers used to increase the viscosity of fracturing fluids may be detrimental to permeability in the vicinity of the fractures, so techniques referred to as slick water fracturing have been developed. These techniques do not utilize thickening polymers, but instead rely on rapid injection of fracturing fluids.

Fracturing methods are disclosed in, for example, U.S. Pat. Nos. 8,183,179, and 7,451,820, the disclosures of which are incorporated herein by reference.

It would be desirable to be able to determine the results of a fracturing operation with respect to, for example, how many fractures were effectively opened when a cluster of fractures are created at one time, or how much fluid was entering each of the different fractures at the end of the fracturing operation as an indicator of the relative size of the different fractures. US patent application publication 2012/0193090 suggests a method by which a sensor may be placed in or just below the fluid flow path of the fracturing fluids, but the information which can be captured by this sensor is limited by the single location of the sensor.

SUMMARY OF THE INVENTION

The present invention is a method to determine where fractures are created within a wellbore during a formation fracturing operation, the method comprising the steps of: providing at least one sensor within a carrier capable of measuring and recording a pressure difference across the carrier as a function of time; releasing the sensor into fracturing fluids; injecting fracturing fluids into a wellbore during a fracturing operation; after at least one fracture has formed, permitting fluids to flow back from the fractured formation into the wellbore and to a surface facility; capturing at least one sensor from the fluids which flowed back from the fractured formation; reading recorded data from the captured sensor; and determining the relative size of at least two different fractures based on the recorded data.

DETAILED DESCRIPTION

Sensors of the present invention could be provided as described in SPE paper 159583, "A Distributed Microchip System for Subsurface Measurement" by Yu et al. This paper describes sensors encapsulated in spheres having about 7.5 mm diameters. Each sphere includes battery, sensors, control circuits, memory circuits, and antenna coil. The examples provided have temperature and pressure sensors included. Differential pressure could be provided by providing a plurality of pressure sensors surrounding the spheres. Data from the pressure sensors could be used to obtain both absolute pressure and differential pressure across the sphere. The sensor may be made in a Complementary Metal-Oxide-Semiconductor ("CMOS") technology. This allows digital controller circuit, memory, analog signal conditioning circuit, analog-to-digital converter, radio frequency transmitter and receiver to be made on the same silicon substrate. This makes possible a very small size, low power consumption and low manufacturing cost.

The sensors could be equipped with accelerometers to indicate movement of the sensor. The sensors could also include a gravitometer to indicate which direction is up and down, so that the direction of motion could be determined. Inclusion of more types of sensors may result in a larger sensor, but a optional feature of the present invention is that the sensor is sufficiently small so that it does not significantly block flow of frac fluids through a perforation or entry into a fracture if it becomes lodged in the entry to the perforation or fracture. Therefore the sensor having this feature may be of a diameter of less than one inch, or 2.54 cm. For example, the diameter could be between 0.2 cm and 3 cm, or between 0.5 cm and 2 cm.

Alternatively, the sensor could be the size of a diversion ball, and inserted as a diversion ball. Diversion balls are injected into a wellbore during a fracturing operation where multiple sets of perforations are fractured at the same time. The diversion balls are injected to at least partially plug perforations into which larger flows of fracturing fluids and proppants are passing. By at least partially plugging these perforations, more fracturing fluid is forced into other perforations, making more equally sized fractures. Data collected by the sensor in diversion balls could be used to determine which perforations, if any, the diversion ball entered. Diversion balls without sensors are available, for example, from Benoil Services Ltd., Kennet Buildings, Trade Street, Woolton Hill, Newbury, Berkshire, RG20 9UJ, United Kingdom. These balls could be up to three inches in diameter, and could have specific gravities of between 0.8 and 1.96, depending on the size of perforations intended to be plugged, and the density of the fluids utilized.

Another completion method used frac ports instead of perforations. The one or multiple frac ports are opened individually by sliding sleeves. These sleeves can be installed in wells with cemented casing or wells using un-cemented liner with openhole packers system. The sleeves are activated by injecting a ball at surface. One type of ball drop system uses incremental increase in ball size to activate a specific sleeve, novel systems use a single ball size. The data collected by the sensors could be used to determine if the ball reached its intended sleeve and travel time till the ball hit the seat. The differential pressure across the sphere specifically would confirm of successful pressure seal. For example the sensor is able to collect information if the sleeve was activated at lower than designed pressure in which case a pressure indication at surface would be too small to detect or if due to high pressure differential across the seat the ball would be extruded through and stage isolation is lost.

The sensors may be encapsulated in polymer shell to protect the sensor, and may be partially filled with hollow spheres for buoyancy. The total weight to volume of the sensor is preferably matched to the density of frac fluid so that the sensor will be neutrally buoyant, and neither tends to sink nor float in the fracturing fluid, and therefore tend to follow the flow of the fluid. Using neutrally buoyant sensors provides a more accurate estimate of position possible based on fluid velocity in wellbore tubulars and also provides more reliable return of the sensors with flow-back from fractures after the fracturing operation.

Buoyancy of the sensor balls could also change as a function of time. Sensor at least slightly more dense than the wellbore fluids could be injected to provide a set of sensor readings traveling down the wellbore, or into fractures. After time, or exposure to down-hole temperatures, the sensor balls could be designed to lose mass, expand, or otherwise, become less dense, enabling them to return with wellbore fluids more readily.

The sensors could be injected into the fracturing fluid flow line, preferably downstream of any pumps and control valves. A slip stream of high pressure fracturing fluid from the discharge of a fracturing pump, or high pressure gas, could be used to motivate a sensor from a holding cell into fracturing fluid flow line. The high pressure gas could be, for example, natural gas or nitrogen. The injection is preferably automated so that once initiated, the injection would be at regular intervals, or could be initiated automatically or manually to coincide with certain phases of the fracturing operation. For example, fracturing fluid could be injected to initiate fractures without proppant, and then proppant would be added to the fracturing fluid for a time period, and then fracturing fluid without proppant may be injected. In one embodiment, the sensors are injected immediately after addition of proppant to the fracturing fluid is ceased, but fracturing fluid is still being injected.

Sensors injected early in the period of proppant injection might be trapped in fractures by proppant, and never flow back with formation fluids after the fracturing operation is completed. Fracturing fluid injected after proppant has been injected may be injected at pressures that are less than fracture propogation pressures so that the fractures are subjected to flow of fracturing fluid but not expansion of the fractures. Retrieval of the sensors is needed in order for recorded information to be obtained from the sensor.

An optional feature of the present invention is that plurality of sensors may be injected near the end of the period for which proppant is injected. In another embodiment, a plurality of sensors may be injected starting at the end of the period for which proppant is injected. In one embodiment, a sufficient number of sensors is injected during this period so that a statistically based estimate could be made of the flow of fracturing fluid to each of the fractures could be made, along with determination of the location of the fractures. The flow of fracturing fluid to each of the fractures is an indicator of the relative size of the fracture compared to the other fractures into which fracturing fluid is flowing. For example, twenty to sixty sensors could be released at intervals of, for example, ten to sixty seconds, so that flow back of the sensors would represent flow back of a number of sensors from each fracture that is proportional to the flow of fracturing fluid into each fracture during this operation.

After a fracturing operation, fluids are typically permitted to flow back from the formation. These fluids are initially the fluid it typically similar to the fluids initially injected, possibly with higher levels of dissolved solids because of the exposure to divalent cations in the formation.

Sensors returning to the surface, for example, with flow back after a fracturing operation, may be either captured, or integrated as they flow past antennas around return fluid piping. It is preferable to capture the sensors both for reuse. Capturing the sensors also permits recharging of the sensor so that data may be transmitted from the sensor with greater power or downloading data via a hard wired connection rather than through a wireless transmission.

An optional feature of the present invention is that an accurate time indication for the time the sensor is launched is provided. This may be an electronic recording of time based on, for example, a pressure spike caused by the launch, a wireless signal transmitted and received by the sensor in the vicinity of the wellhead.

Data read from a captured returned sensor could be used, for example, to determine the locations of fractures within the formation. The rate at which fracturing fluids are pumped are typically measured, and this measurement, along with knowledge of the dimensions of the wellbore and the wellbore tubular, and assuming, for example, plug flow through the tubular would permit calculation of the distance down the wellbore before sensors flow into an entrance to a perforation or fracture. The time to reach this point may be determined, for example, based on input from gravitometers, accelerometers, or by indication of an increase in pressure drop across the sensor. When multiple fractures are generated in the same cluster, after the fracturing fluid passes the first fracture, the velocity of the sensor may no longer be determined from the flow rate of fracturing fluid being pumped and the dimensions of the wellbore because some of the fracturing fluid leaves the wellbore and enters the first fracture. If the velocity of the sensor may be determined by, for example, integrating the recorded accelerations, the flow rate of fracturing fluids between fracture openings may be determined based on the cross-sectional area of the wellbore at that point and the velocity of the fracturing fluids between the fracture openings. Knowing the flow rate of fracturing fluids between fracture openings permits calculation of the flow rate of fluids into each fracture opening, and this is an indication of the size of each fracture. The relative size of different fractures could therefore be determined.

An optional method to determine the history of the travel of a sensor of the present invention is, for example, to locate Radio Frequency Identification ("RFID") tags in collars for the casing string, or otherwise between perforation locations and have the sensor detect either which tags they pass, or how many tags they pass in the round-trip down and then back up the well. RFID technology such as that disclosed in U.S. Pat. No. 4,384,288, is widely available and can be obtained in extremely small sizes and power requirements.

In another optional feature is that plurality of sensors are injected, so that multiple sensors are captured in the entrance to each opened fracture, and by determination of which fracture each sensor was caught in, the relative flow of fracturing fluids into each of the fractures could be determined by an assumption that the flow of fluids is proportional to the number of sensors caught by each fracture opening.

Useful information could also be obtained from a temperature history recorded by the sensors.

What is claimed is:

1. A method to determine where fractures are created within a wellbore during a formation fracturing operation, the method comprising the steps of:

providing at least one sensor within a carrier capable of measuring and recording a pressure difference across the carrier as a function of time;

releasing the at least one sensor into a fracturing fluid;

injecting the fracturing fluid into which the at least one sensor was released into a wellbore during the fracturing operation;

after at least one fracture has formed, permitting fluids to flow back from the fractured formation into the wellbore;

capturing at least one sensor of the at least one sensor released into the fracturing fluid from the fluids which flowed back from the fractured formation;

reading recorded data from at least one sensor of the at least one captured sensor; and determining the relative size of at least two different fractures based on the recorded data.

2. The method of claim 1 wherein a plurality of sensors are released into the fracturing fluid.

3. The method of claim 1 wherein the sensor record, in addition to pressure difference across the carrier as a function of time, temperature as a function of time, and the temperature history, is used to determine a time period over which the fracture fluid is entering a fracture during the fracturing operation.

4. The method of claim 1 wherein the sensor records, in addition to the pressure difference across the carrier as a function of time, the ambient pressure as a function of time and the pressure is included in the recorded data.

5. The method of claim 1 wherein the at least one sensor released into the fracturing fluid is released into the fracturing fluid by injecting the at least one sensor released into the fracturing fluid into the discharge of a fracturing fluid pump using high pressure gas.

6. The method of claim 1 wherein a plurality of sensors are released into the fracturing fluid at regular intervals of time during a time period over which the fracturing fluid is injected into the wellbore.

7. The method of claim 6 wherein the regular intervals of time are between one and ten minutes.

8. The method of claim 7 wherein the regular intervals of time are between two and five minutes.

9. The method of claim 1 wherein the fracturing fluid is injected into the wellbore with proppant.

10. The method of claim 9 wherein the fracturing fluid is injected into the wellbore without proppant following injection of the fracturing fluid into the wellbore with proppant.

11. The method of claim 10 wherein the at least one sensor released into the fracturing fluid is released into the fracturing fluid injected into the wellbore without proppant following injection of the fracturing fluid into the wellbore with proppant.

12. The method of claim 1 further comprising determining locations of a plurality of fractures based on the recorded data.

13. The method of claim 12 wherein the relative size of the plurality of fractures is determined by the recorded data.

* * * * *